US005644936A

United States Patent [19]

Yasutake et al.

[11] Patent Number: 5,644,936

[45] Date of Patent: Jul. 8, 1997

[54] WASHING CONTROL DEVICE AND WASHING CONTROL SYSTEM

[75] Inventors: Kouichi Yasutake, Kyoto; Syusuke Haruna, Itami; Yuki Kusumi, Kashiba; Takuya Sekiguchi; Toshihiro Hishida, both of Neyagawa, all of Japan

[73] Assignee: Matsushita Electric Industrial Co., Ltd., Osaka-fu, Japan

[21] Appl. No.: 529,987

[22] Filed: Sep. 19, 1995

[30] Foreign Application Priority Data

Sep. 30, 1994 [JP] Japan ..... 6-237975

[51] Int. Cl.[6] ..... D06F 33/02

[52] U.S. Cl. ..... 68/12.02; 68/12.27

[58] Field of Search ..... 68/12.01, 12.02, 68/12.27

[56] References Cited

U.S. PATENT DOCUMENTS 5,388,299 2/1995 Lee ..... 66/12.02 X

FOREIGN PATENT DOCUMENTS 29696 2/1991 Japan ..... 68/12.27

*Primary Examiner*—Philip R. Coe

*Attorney, Agent, or Firm*—Price, Gess & Ubell

[57] ABSTRACT

A washing process control procedure displayed as a mark is read and its content is interpreted. After this, washing processes are automatically controlled in accordance with the interpreted washing process control procedure. As a result, a most suitable washing method can be achieved in accordance with the washing agent used and the garment to be washed.

9 Claims, 17 Drawing Sheets

FIG. 2

21 22 23 24

| EXECUTION ORDER | PROCESS | NUMBER OF EXECUTIONS | DURATION |
|---|---|---|---|
| 1 | SOAK | 1 | 30 |
| 2 | WASH | 1 | 10 |
| 3 | RINSE | 3 | 20 |
| 4 | SOAK | 1 | 20 |
| 5 | SPIN | 2 | 5 |

0

25

| EXECUTION ORDER | PROCESS | NUMBER OF EXECUTIONS | DURATION |
|---|---|---|---|
| 1 | SOAK | 1 | 30 |
| 2 | WASH | 1 | 10 |
| 3 | RINSE | 3 | 20 |
| 4 | SOAK | 1 | 20 |
| 5 | SPIN | 2 | 5 |

FIG. 14

92 0

| WASHING AGENT IDENTIFICATION CODE | WASHING PROCESS CONTROL PROCEDURE | | | |
|---|---|---|---|---|
| | EXECUTION ORDER | PROCESS | NUMBER OF EXECUTIONS | DURATION |
| ID00000120000023980 | 1 | SOAK | 1 | 30 |
| | 2 | WASH | 1 | 10 |
| | 3 | RINSE | 3 | 20 |
| | 4 | SOAK | 1 | 20 |
| | 5 | SPIN | 2 | 5 |
| | EXECUTION ORDER | PROCESS | NUMBER OF EXECUTIONS | DURATION |
| ID00000120041550980 | 1 | SOAK | 1 | 30 |
| | 2 | | | 10 |

FIG. 15

102 0

| GARMENT IDENTIFICATION CODE | WASHING PROCESS CONTROL PROCEDURE | | | |
|---|---|---|---|---|
| | EXECUTION ORDER | PROCESS | NUMBER OF EXECUTIONS | DURATION |
| ID00000199999991122 | 1 | SOAK | 1 | 30 |
| | 2 | WASH | 1 | 10 |
| | 3 | RINSE | 3 | 20 |
| | 4 | SOAK | 1 | 20 |
| | 5 | SPIN | 2 | 5 |
| | EXECUTION ORDER | PROCESS | NUMBER OF EXECUTIONS | DURATION |
| ID00000120041550980 | 1 | SOAK | 1 | 30 |
| | 2 | | | 10 |

FIG. 16

161 0

| WASHING AGENT IDENTIFICATION CODE | WASHING PROCESS CONTROL PROCEDURE | | | |
|---|---|---|---|---|
| | EXECUTION ORDER | PROCESS | NUMBER OF EXECUTIONS | DURATION |
| ID00000120000023980<br>ID00000199999991122 | 1 | SOAK | 1 | 30 |
| | 2 | WASH | 1 | 10 |
| | 3 | RINSE | 3 | 20 |
| | 4 | SOAK | 1 | 20 |
| | 5 | SPIN | 2 | 5 |
| | EXECUTION ORDER | PROCESS | NUMBER OF EXECUTIONS | DURATION |
| ID00000120041550980<br>[illegible]439999980 | 1 | SOAK | 1 | 30 |
| | 2 | [illegible] | [illegible] | 10 |

WASHING CONTROL DEVICE AND WASHING CONTROL SYSTEM

BACKGROUND OF THE INVENTION

1. Field of the Invention

The present invention relates to a washing control device and a washing control system which can control washing processes.

2. Description of the Related Art

Conventional washing machines equipped with microcomputers allow the user to select a control pattern for several washing processes by means of a button operation, so that the user can make their selection taking into account the nature of the clothes to be washed (such as the kind of fibre and kind of weave) and the extent to which the clothes are soiled, and so have the clothes washed accordingly. As examples, the duration of the wash cycle can be selected as twelve minutes, six minutes or three minutes, heavily soiled clothes can be washed after first being soaked, the duration of the spin cycle can be selected as five minutes, three minutes or one minute, flowing water rinse can be selected for clothes which require a gentle rinse, one or two rinse cycles can be selected, and the strength of the rinse action can be selected as standard or soft, so that the content of the wash control program, and therefore the wash program which is executed, can be set according to the wishes of the user.

Furthermore, there are also washing machines which feature a number of wash menus in order to simplify the button operation for the user, so that when the user presses a button to select one of the wash menus, the washing program will be executed according to the selected wash menu. If, for example, the machine is provided with a number of washing programs, such as a standard cycle, a fast cycle and a wool cycle, then the duration of the standard cycle may be forty minutes, the duration of the fast cycle may be thirty minutes, and the duration of the wool cycle may be fifteen minutes, with the wash control to be executed for each of the different menus being set beforehand.

However, in recent years, the number of washing agents on the market which require the execution of processes which differ from those for conventional detergents (these include, for example, washing agents which enable a same level of washing results as dry cleaning to be achieved using a conventional washing machine) and the number of garments made from fibers which require washing processes which differ from those for conventional fibers (for example, highly-absorbent diaper covers) have increased, so that the washing control programs provided in conventional washing machines are no longer up to the task of dealing with such washing agents or garments.

As such garments and washing agents have come onto the market, new washing methods have also been developed. As one example, Japanese Laid Open Patent Application No. 63-154196 teaches a washing control device which uses a light sensor to investigate the penetration of the detergent and controls the duration of the wash cycle based on changes in this amount, as well as on the type of detergent used, this being detected by measuring the electrical conductivity of the detergent.

However, even if such a washing control device is used, it cannot be said that the most suitable washing program for different fibers or for different washing agents will be executed. As a result, a method can be conceived which uses a programmable washing machine controller, so that the washing machine can be operated in accordance with the washing agent to be used, the fibers in the garments to be washed and the precise washing program control instructions of the user. However, the installment of such a programmable controller will inevitably lead to an increase in the number of button operations and an increase in the complexity of the wash menus, so that the user will be forced to make complicated button operations, making the device totally unsuitable for use as a domestic washing machine.

SUMMARY OF THE INVENTION

The present invention was conceived in view of the problems described above, and its primary object is to provide a washing control device and washing control system for which the realization of a most suitable washing method for a garment to be washed and washing agent to be used is possible.

This object can be achieved by a washing control device which automatically controls every washing process in accordance with a washing process control procedure displayed on one of a washing agent package, a garment to be washed and a booklet, comprising: a reading unit for reading the displayed washing process control procedure from one of the washing agent package, the garment to be washed and the booklet; an interpretation unit for interpreting a content of the read washing process control procedure; and an execution unit for automatically controlling every washing process in accordance with the interpreted content of the read washing process control procedure.

The washing process control procedure may be displayed as a bar code, and the read washing process control procedure may be a predetermined set of an execution order for each washing process, a number of executions for each washing process, an execution duration for each washing process and any other control information, for each separate washing case in accordance with one of a kind of washing agent and a kind of garment to be washed.

The interpretation unit may read the washing process control procedure, written as a bar code, in order of execution for each washing process, interpret control information included therein and generate a control sequence for the control information.

The execution unit may control every separate washing operation for each washing process in accordance with the generated control sequence.

The washing control device may further include: a transmission unit for transmitting, by means of one of a cable method and a cordless method, code for the read washing process control procedure in order to inform the interpretation unit; and a reception unit for receiving, by means of one of a cable method and a cordless method, the code for the read washing process control procedure and informing the interpretation unit.

The above object can also be achieved by a washing control system for executing washing processes by automatically controlling each washing process according to an appropriate washing process control procedure, comprising: a washing process control procedure display mark which is an encoded set of washing instructions fixed according to at least one of a washing agent and a garment to be washed, said display mark being displayed on one of a washing agent package, a garment to be washed and a booklet; a reading unit for reading the washing process control procedure display mark and at least one of a washing agent identification code displayed as a mark and a garment identification code displayed as a mark; a storage unit for storing read washing process control procedures; a retrieval unit for retrieving an appropriate washing process control procedure out of the stored washing process control procedures; an interpretation unit for interpreting information in a retrieved washing process control procedure; and an execution unit for automatically controlling every washing process in accordance with the interpreted information in the washing process control procedure.

The washing process control procedure, the washing agent identification code and the garment identification code read by the reading unit may each be represented by a separate bar code, and the read washing process control procedure may be a predetermined set of an execution order for each washing process, a number of executions for each washing process, an execution duration for each washing process and any other control information, for each separate washing case in accordance with one of a kind of washing agent, a kind of garment to be washed, and a combination of a kind of washing agent and a kind of garment to be washed.

The storage unit may store each read washing process control procedure corresponded to one of a washing agent identification code, a garment identification code, and a combination of a washing agent identification code and a garment identification code.

The retrieval unit may retrieve the appropriate washing process control procedure out of the stored washing process control procedures using at least one of a washing agent identification code and a garment identification code as a retrieval key.

The interpretation unit may read the washing process control procedure, written as a bar code, in order of execution for each washing process, interpret control information included therein and generate a control sequence for the control information.

The execution unit may control every separate washing operation for each washing process in accordance with the generated control sequence.

The washing control system may further include: a first transmission unit for transmitting, by means of one of a cable method and a cordless method, code for the read washing process control procedure, and at least one of the read washing agent identification code and the read garment identification code, in order to inform the interpretation unit, and for transmitting an operation mode indication signal indicating an operation mode for a main washing machine, wherein an operation mode to be indicated to the main washing machine is one of a registration mode for registering a transmitted washing process control procedure and a retrieval mode for retrieving an appropriate washing process control procedure from the stored washing process control procedures; a first reception unit for receiving, by means of one of a cable method and a cordless method, code for the transmitted washing process control procedure, and one of the transmitted washing agent identification code, the transmitted garment identification code and a transmitted combination of the washing agent identification code and garment identification code, wherein for cases when one of the washing agent identification code and the garment identification code is transmitted after the other, the first reception unit receives the washing agent identification code and the garment identification code as a combination code; a registration unit for registering, when an operation mode indication signal indicating registration mode is received, and passing over to the storage unit a received washing process control procedure corresponded to one of the received washing agent identification code, the received garment identification code and the received combination of the washing agent identification code and garment identification code; a second transmission unit transmitting a retrieved washing process control procedure in order to inform the interpretation unit; and a second reception unit for receiving the washing process control procedure transmitted by the second transmission unit in order to inform the interpretation unit.

By means of the above washing control device, after reading a washing process control procedure displayed as a mark, the washing process is automatically controlled in accordance with the read procedure. As a result, a most suitable washing method can be achieved in accordance with the washing agent used and the garment to be washed.

Furthermore, by means of the washing control system constructed as described above, after reading a washing process control procedure displayed as a mark, the procedure is first stored so that when washing is executed, a predetermined procedure is selected out of the stored washing process control procedures and the washing process is automatically controlled in accordance with the read procedure. As a result, a most suitable washing method can be achieved in accordance with the washing agent used and the garment to be washed.

BRIEF DESCRIPTION OF THE DRAWINGS

These and other objects, advantages and features of the invention will become apparent from the following description taken in conjunction with the accompanying drawings which illustrate a specific embodiment of the invention. In the drawings:

FIG. 2 is a drawing showing an example of the washing process control procedure executed by the washing control device shown in FIG. 1;

FIG. 14 is a table showing a first example of the stored content of the washing process control procedures stored by the washing process control procedure storage means 86;

FIG. 15 is a table showing a second example of the stored content of the washing process control procedures stored by the washing process control procedure storage means 86;

FIG. 16 is a table showing a third example of the stored content of the washing process control procedures stored by the washing process control procedure storage means 86.

DESCRIPTION OF THE PREFERRED EMBODIMENTS

Figure 1:
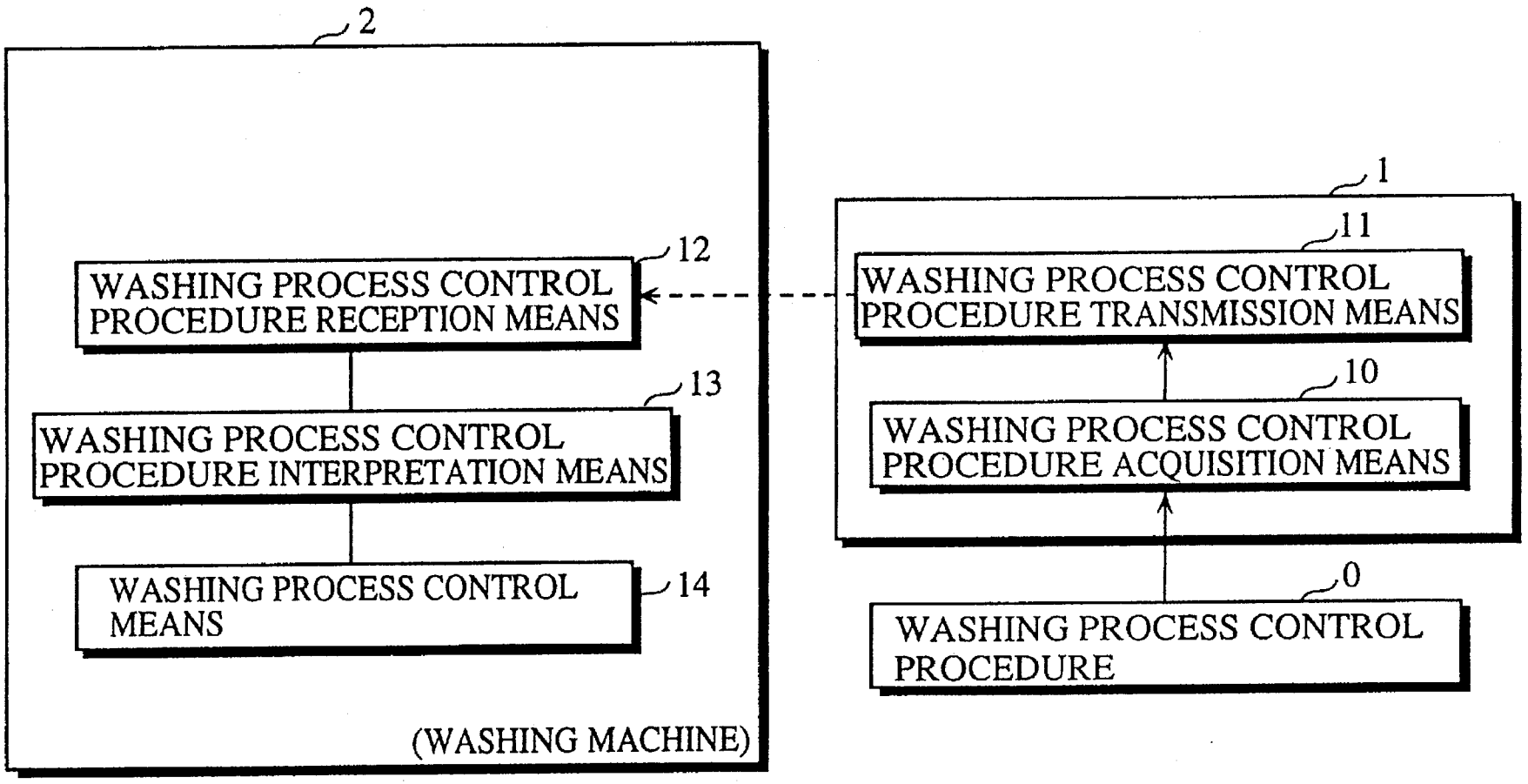
FIG. 1 is a block diagram showing the entire construction of the washing control device of the first embodiment of the present invention.

The following is a detailed description of the first embodiment of the present invention, with reference to the drawings. FIG. 1 is a block diagram showing the construction of the washing control device of the first embodiment of the present invention. The present washing control device is made up of a transmission unit 1 formed outside the main body of the washing machine and a washing control unit 2 disposed as part of the main body of the washing machine. The transmission unit 1 is for sending the washing process control procedure 0, which is displayed as a mark, to the washing control unit 2, and is made up of a washing process control procedure acquisition means 10 for reading the washing process control procedure 0 and a washing process control procedure transmission means 11 for transmitting the read washing process control procedure 0. The washing process control procedure acquisition means 10 can be composed of a bar code reader when the washing process control procedure is given as a bar code (see FIG. 2) while the washing process control procedure transmission means 11 can be composed of a remote control device, which may be wireless or which may use a cable.

On the other hand, the washing control unit 2 is designed to control all of the washing processes and is made up of a washing process control procedure reception means 12 for receiving the washing process control procedure from the washing process control procedure transmission means 11, a washing process control procedure interpretation means 13 for interpreting the received washing process control procedure, and a washing process control means 14 for controlling all of the washing processes in accordance with the result of the interpretation of the control procedure. More precisely, this means that the opening and closing of the drain valve, the rotational speed and direction of the motor, on/off, and every judgement of sensor messages which are necessary for washing control are controlled by the washing process control means 14.

FIG. 2 is a drawing showing an example of the washing process control procedure 0 to be executed by the washing control device shown in FIG. 1. Here, column 21 shows the execution order of the control contents shown in columns 22 through 24, column 22 shows the washing processes, column 23 shows the number of executions for each of the washing processes, and column 24 shows the execution time for each of the washing processes. In this way, each washing process has at least one entry in the table, with each of them being a combination which is used as the minimum unit for the washing process control procedure 0. Furthermore, 25 is a bar code for the washing process control procedure 0 with its control contents including all of the information shown in columns 22–24, with this bar code being read by the washing process control procedure acquisition means 10, and its content being transmitted by the washing process control procedure transmission means 11.

For the example shown, the first thirty minute "soaking process" is executed once, followed by one execution of the ten minute "wash process", and then three executions of a twenty minute "rinse process". Following this, a twenty minute "soaking process" is executed once and finally a five minute "spinning process" is executed twice to end the washing process. It should be noted that once the third "rinse process" has been executed, a "cleaning check" may be added, with, depending the detection result of a light sensor built into the machine for this task, the washing program returning to the "wash process" in execution step 2 if the dirt level is 5 or below.

Figure 3:
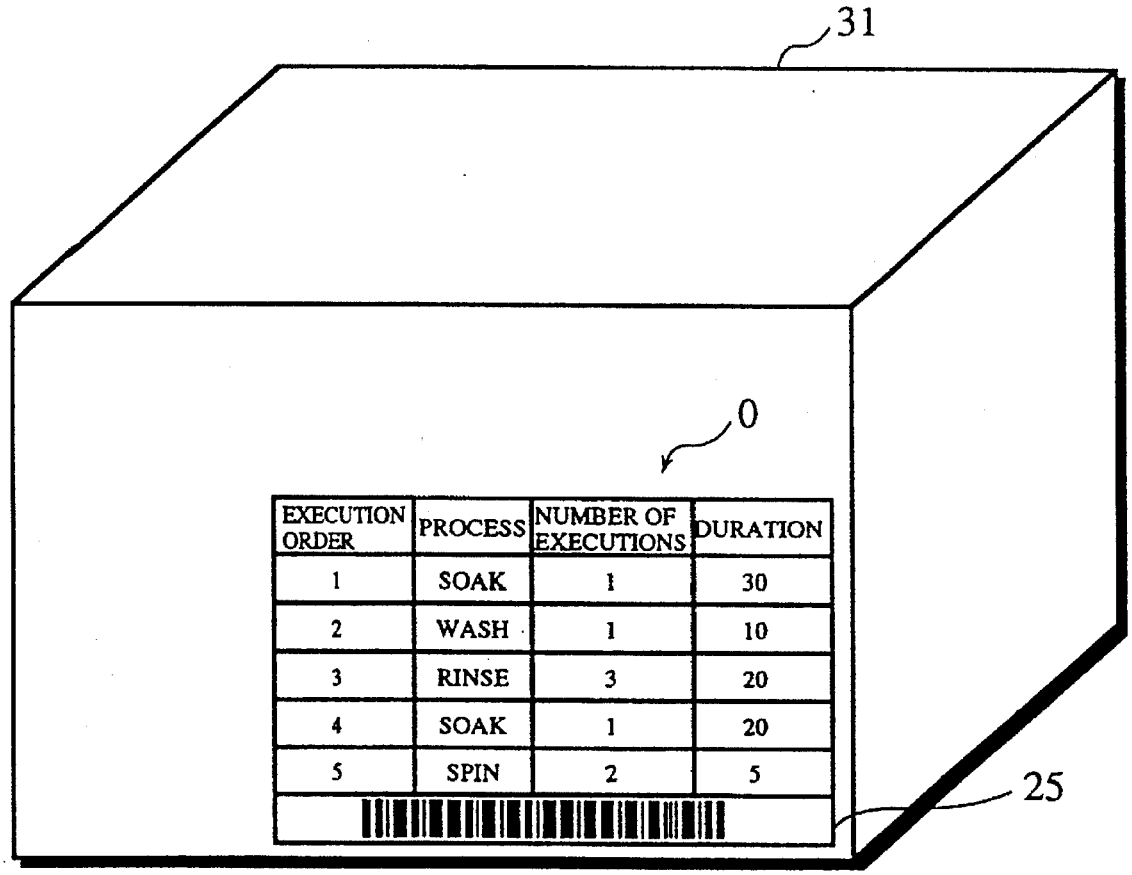
FIG. 3 is a drawing showing the external appearance of a washing agent package which displays the washing process control procedure shown in FIG. 2.

FIG. 3 is a drawing showing the external appearance of a washing agent package which displays the washing process control procedure 0 shown in FIG. 2. As shown in the drawing, the washing process control procedure 0 is printed on the outside of the washing agent package 31, with the bar code 25 included therein being able to be read by a bar code reader.

Figure 4:
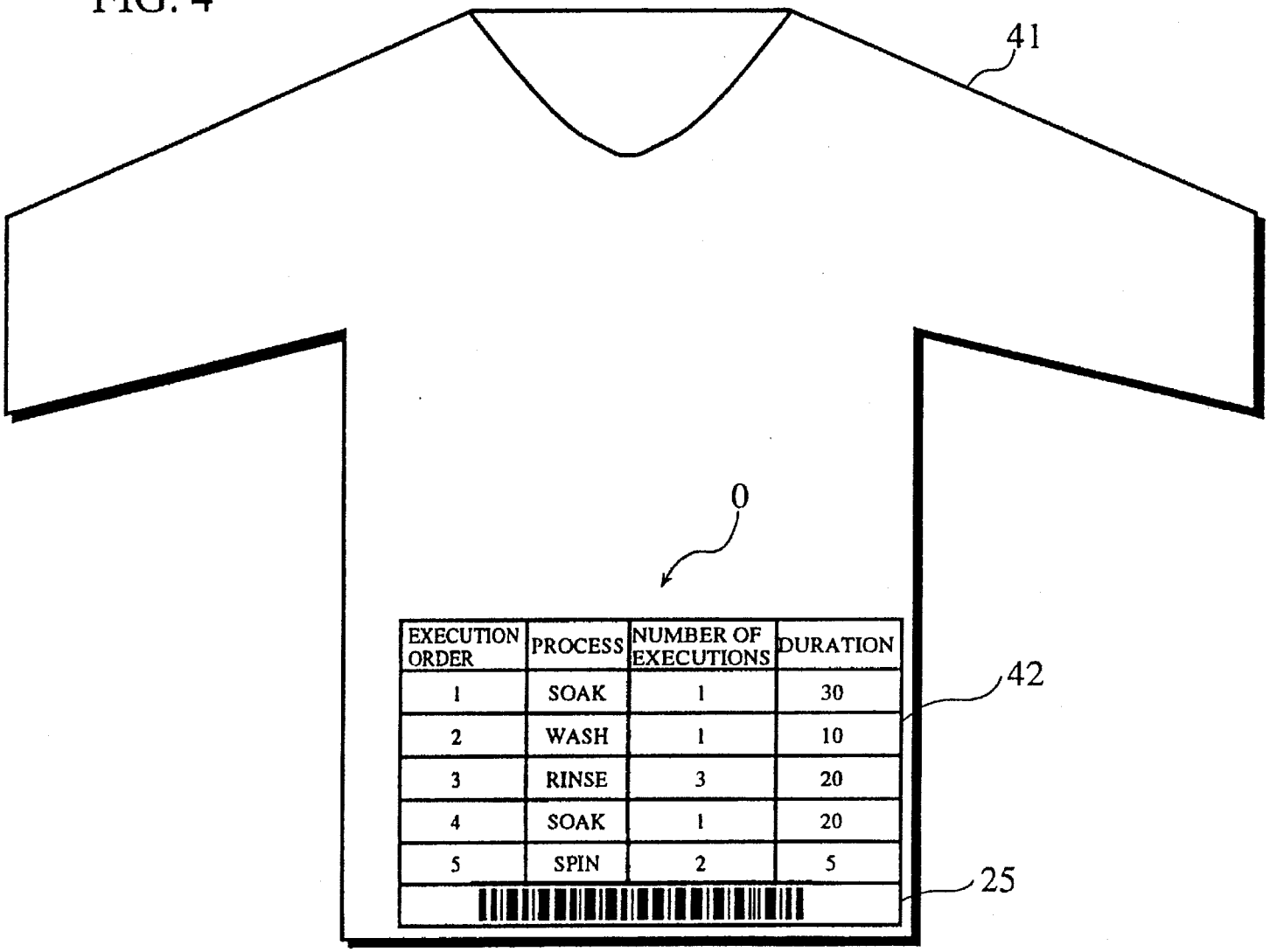
FIG. 4 is a drawing showing a garment to be washed in which a label displaying the washing process control procedure shown in FIG. 2 has been sewn.

FIG. 4 is a drawing showing a garment to be washed into which a label displaying the washing process control procedure 0 shown in FIG. 2 has been sewn. 41 is the garment to be washed (the illustrated example being a sweater), while 42 is the label which shows the washing process control procedure 0 and the bar code 25. It should be noted that in the drawings, the size of the label 42 has been exaggerated, and in reality need only be so large as to allow the bar code 25 to be legible, so that a small label can be sewn into the inside of the garment in the same way as conventional labels which show the nature of the garment or which give washing instructions.

Figure 5:
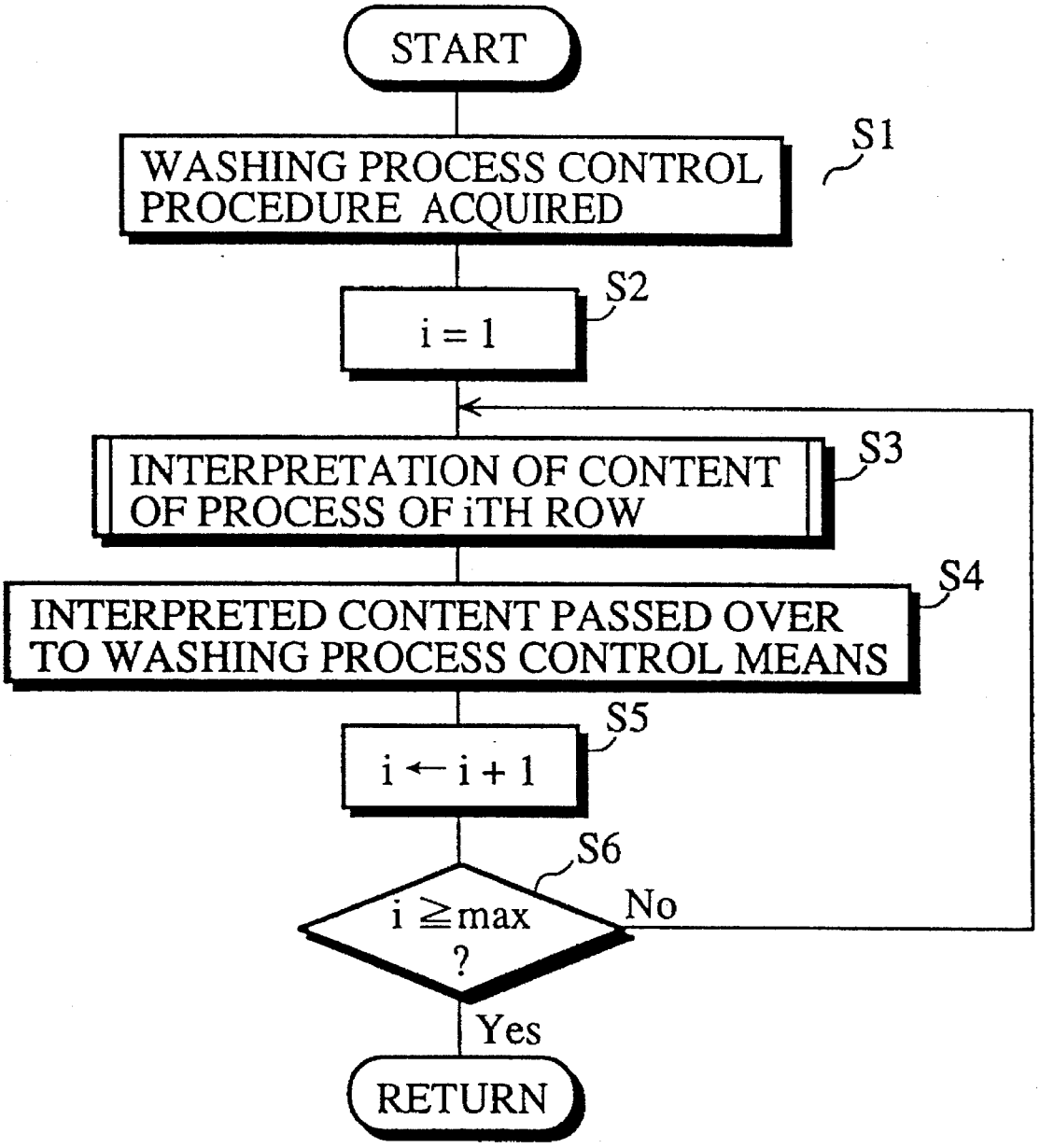
FIG. 5 is a flowchart showing the operation of the washing process control procedure interpretation means 13 shown in FIG. 1.

FIG. 5 is a flowchart showing the operation of the washing process control procedure interpretation means 13 shown in FIG. 1. First, the washing process control procedure interpretation means 13 takes the washing process control procedure 0 received by the washing process control procedure reception means 12 (S1), and sets the parameter i which shows execution order execution as i=1 (S2). Next, it interprets the first part of the control content (S3). More specifically for the example of the washing process control procedure 0 shown in FIG. 2, the washing process control procedure interpretation means 13 interprets the content of the first washing operation, that is "one execution of a thirty minute soak process", as referring to a given filling operation, before a thirty minute termination of operation.

Next, the washing process control procedure interpretation means 13 passes the interpreted control procedure over to the washing process control means 14 (S4), before incrementing the parameter i by one (S5). After this it verifies whether parameter i has reached its maximum number (S6:No), before returning to the process in step S3. The loop S3–S6 is repeated until parameter i reaches its maximum value (S6:Yes) at which point a return is executed. It should be noted here that the number of processes to be executed in the washing process control procedure is set as this maximum value of the parameter i.

Figure 6:
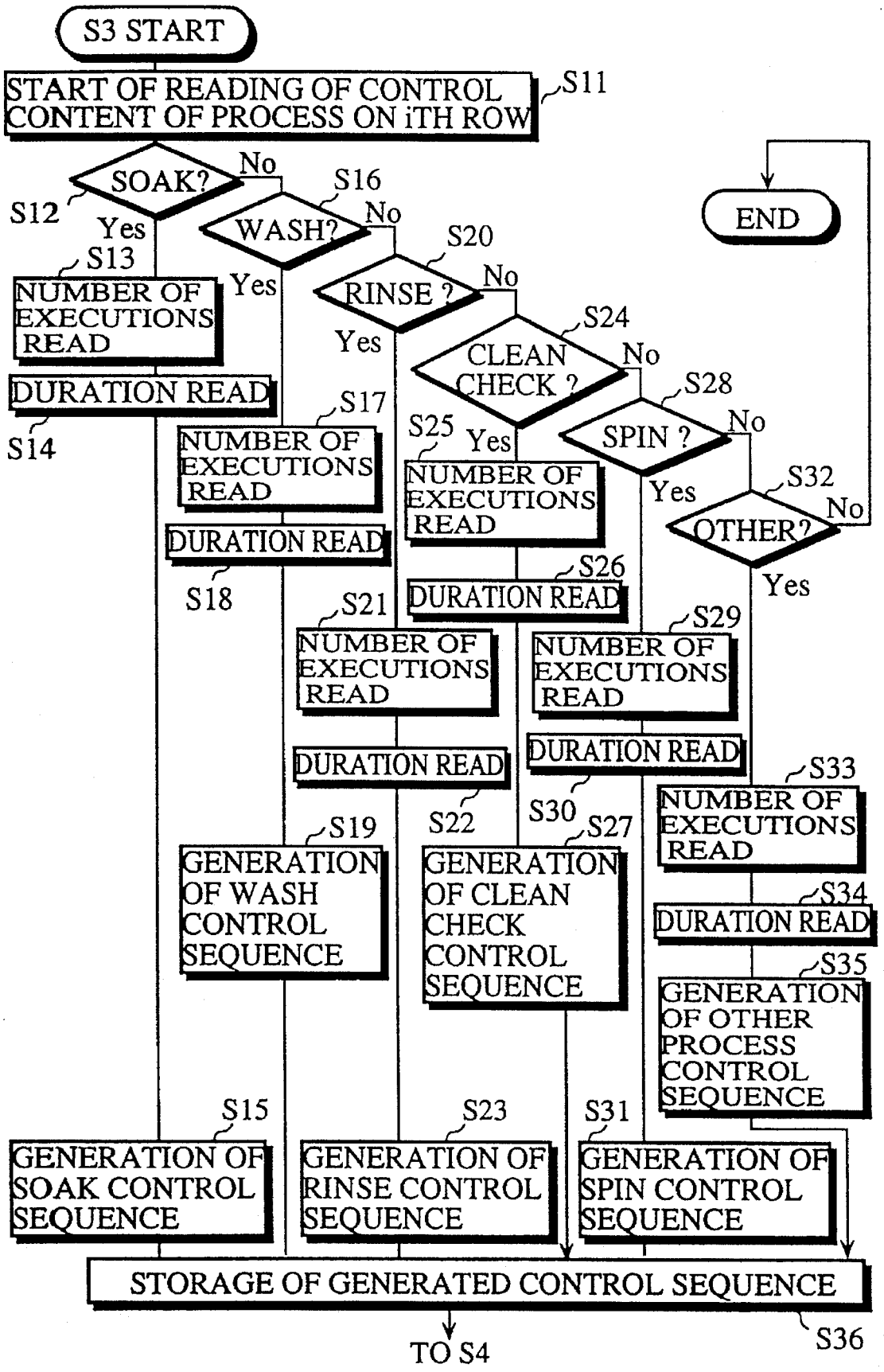
FIG. 6 is a flowchart showing the process in step S3 of the flowchart shown in FIG. 5.

FIG. 6 is a flowchart showing the process in step S3 of the flowchart shown in FIG. 5. First, the washing process control procedure interpretation means 13 starts to read the control content of the process on the ith row of the table of instructions (S11). If the control content of the process on the ith row relates to a soak process (S12:Yes), then the washing process control procedure interpretation means 13 next reads the number of executions (S13), and then the duration of each execution (S14). Following this, the washing process control procedure interpretation means 13 generates a control sequence based on the control content it has read (S15), before storing this generated control sequence (S36).

In the same way, if the control content of the process on the ith row relates to a wash process (S12:No, S16:Yes), or to a rinse process (S16:No, S20:Yes), or to a cleaning check (S20:No, S24:Yes), or to a draining process (S24:No, S28:Yes), or to another process (S28:No, S32:Yes), then in the same way the washing process control procedure interpretation means 13 continues to read the number of executions and the duration of each execution, before generating a control sequence based on the control content it has read, and storing this generated control sequence (S36).

It should be noted that it is this stored control sequence which is passed over to the washing process control means 14 in step S4 in the flowchart shown in FIG. 5. Also, should there be a result "No" in step S32, the process is terminated.

Figure 7:
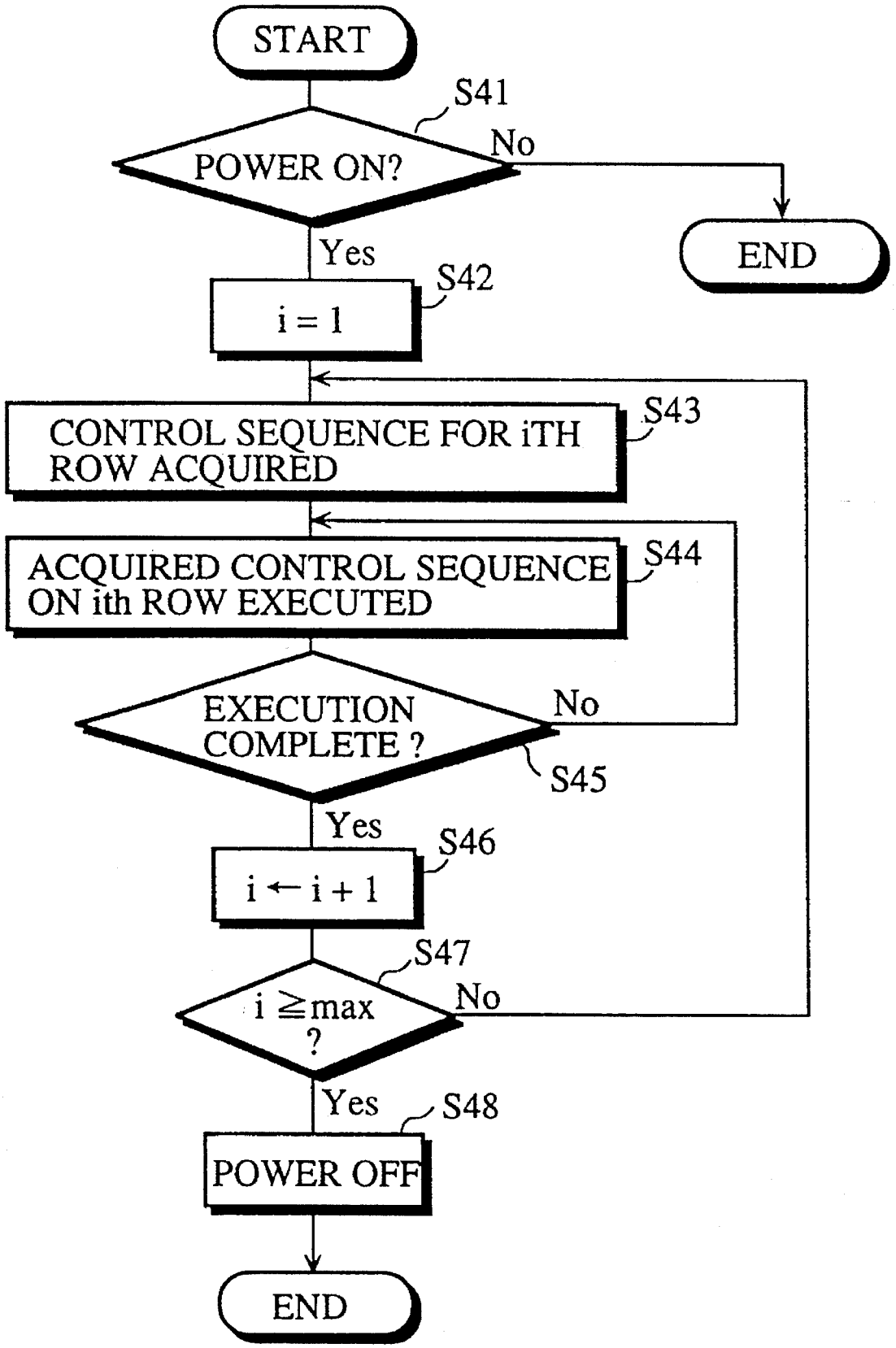
FIG. 7 is a flowchart showing the operation of the washing process control means 14 shown in FIG. 1.

FIG. 7 is a flowchart showing the operation of the washing process control means 14 shown in FIG. 1. First, the washing process control means 14 checks that the washing machine is switched on (S41). Provided it is switched on (S41:Yes), then the washing process control means 14 sets the parameter i which shows execution order execution as i=1 (S42), before receiving the control sequence corresponding to the process in the ith row from the washing process control procedure interpretation means 13 (S43). Next, the washing process control means 14 executes this control sequence corresponding to the process in the ith row (S44).

Following this, once the above process has been completed (S45:Yes), the washing process control means 14 increments the parameter i by one (S46). Next, it verifies whether parameter i has reached its maximum number (S47:No), before returning to the process in step S43. The loop (S43–S47) is repeated until parameter i reaches its maximum value (S47:Yes) at which point it switches the washing machine off (S48), thereby completing the whole process.

Figure 8:
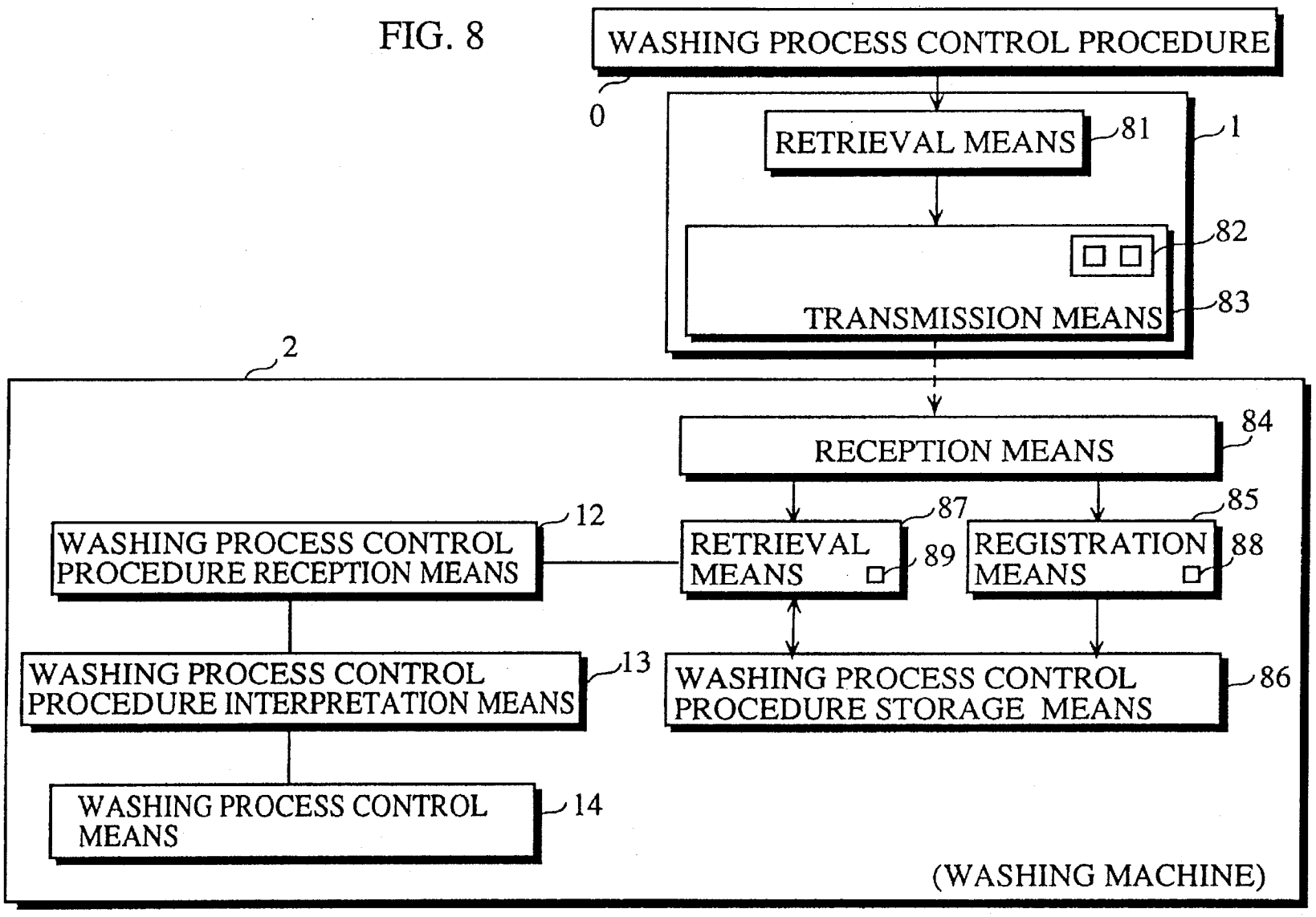
FIG. 8 is a block diagram showing the entire construction of the washing control device of the second embodiment of the present invention.

FIG. 8 is a block diagram showing the entire construction of the washing control device of the second embodiment of the present invention. In the same way as the first embodiment, the present washing control device is made up of a transmission unit 1 formed outside the main body of the washing machine and a washing control unit 2 disposed as part of the main body of the washing machine. The transmission unit 1 is made up of an acquisition means 81 for acquiring the washing process control procedure and a transmission means 11 for transmitting the acquired washing process control procedure and the like, with the transmission means 11 additionally including operation mode indication buttons 82 for selecting the operation modes of the registration means 85 and the retrieval means 87 which are described below. The acquisition means 81 can be composed of a bar code reader when the washing process control procedure is given as a bar code, while the transmission means 11 can be composed of a remote control device which may be wireless or which may use a cable.

On the other hand, the washing control unit 2, is comprised of a reception means 84 for receiving the washing process control procedure and the like from the transmission unit 1, a registration means 85 for registering the received washing process control procedure, a washing process control procedure storage means 86 for storing registered washing process control procedures, and a retrieval means 87 for retrieving a desired washing process control procedure from all of the stored washing process control procedures, in addition to, in the same way as in the first embodiment, a washing process control procedure reception means 12 (which in this embodiment receives the washing process control procedure which has been retrieved by the retrieval means 87), a washing process control procedure interpretation means 13 for interpreting the received washing process control procedure, and a washing process control means 14 for controlling all of the washing processes in accordance with the result of the interpretation of the control procedure.

Furthermore, the registration means 85 includes a mode setting switch 88 for setting its operation mode, while the retrieval means 87 includes a mode setting switch 89 for setting its operation mode.

Figure 9A:
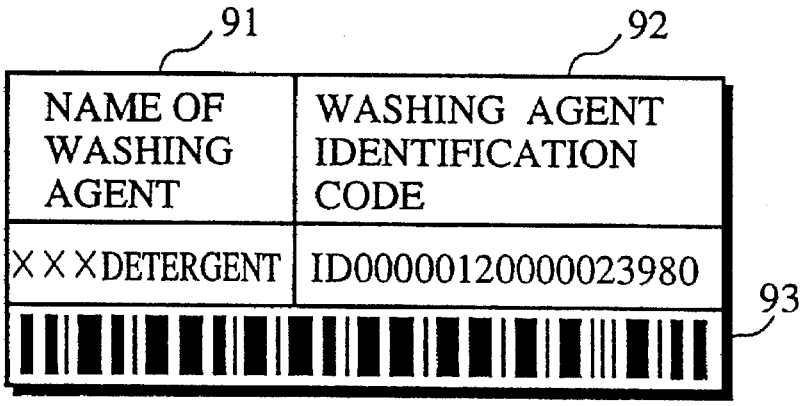
FIG. 9 is a drawing showing the external appearance of a washing agent package which displays the washing process agent identification code used by the washing control device shown in FIG. 8.
Figure 9B:
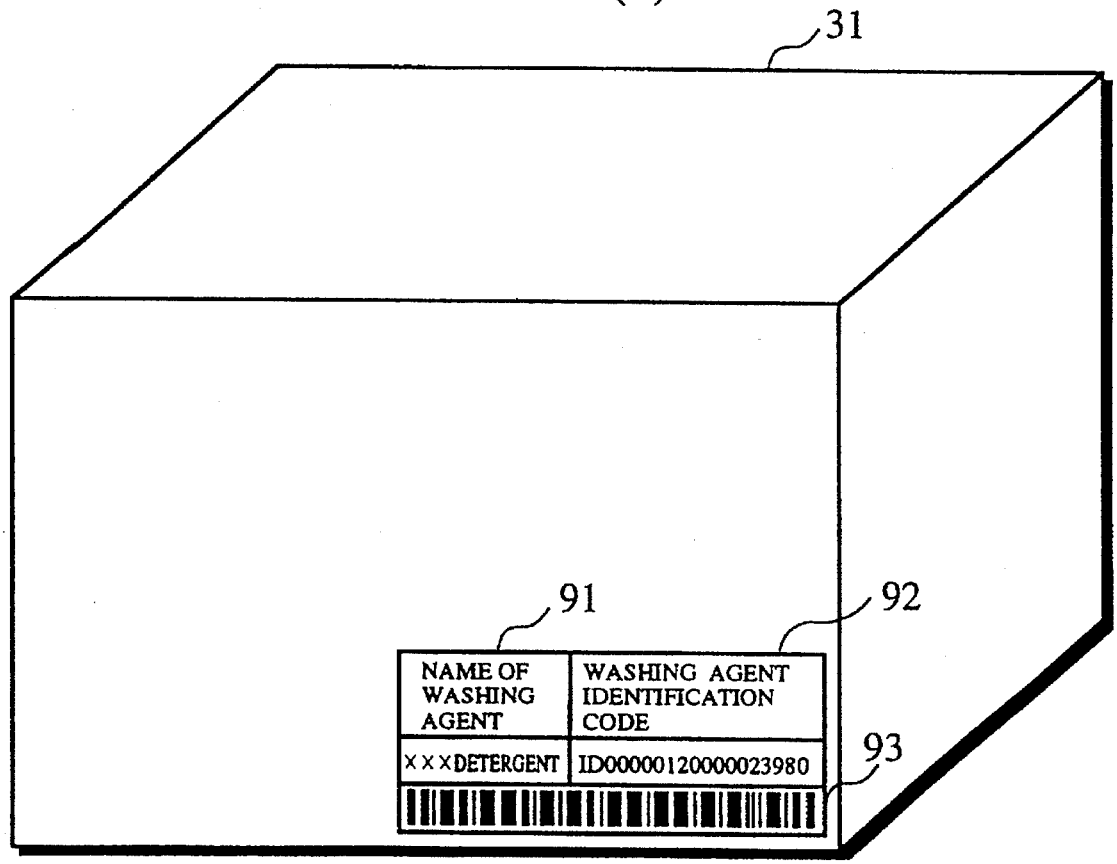

FIG. 9 is a drawing showing the external appearance of a washing agent package which displays the washing agent identification code used by the washing control device shown in FIG. 8. FIG. 9(*a*) shows an example of the washing agent identification code, with the name of washing agent 91 given as [XXX detergent]and the washing agent identification code 92 given as [ID00000120000023980], with both of these being represented by the bar code 93. FIG. 9(*b*) shows the external appearance of a washing agent package on which the information shown in FIG. 9(*a*) is printed, with the bar code 93 included therein being able to be read by a bar code reader.

Figure 10A:
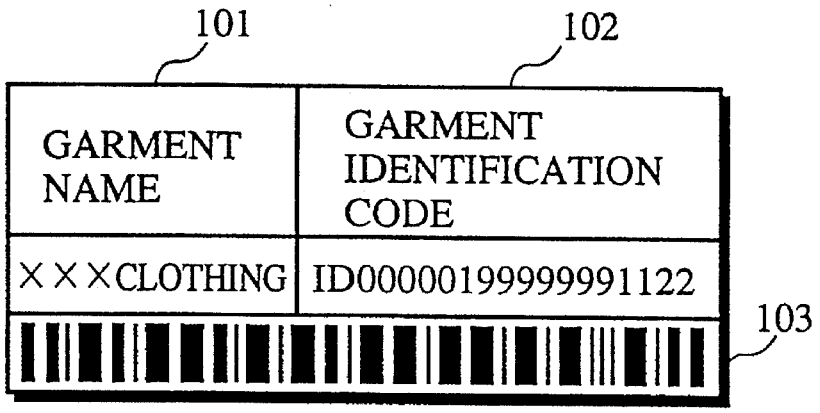
FIG. 10 is a drawing showing a garment to be washed which has a label displaying the clothing type identification code used by the washing control device shown in FIG. 8 attached.
Figure 10B:
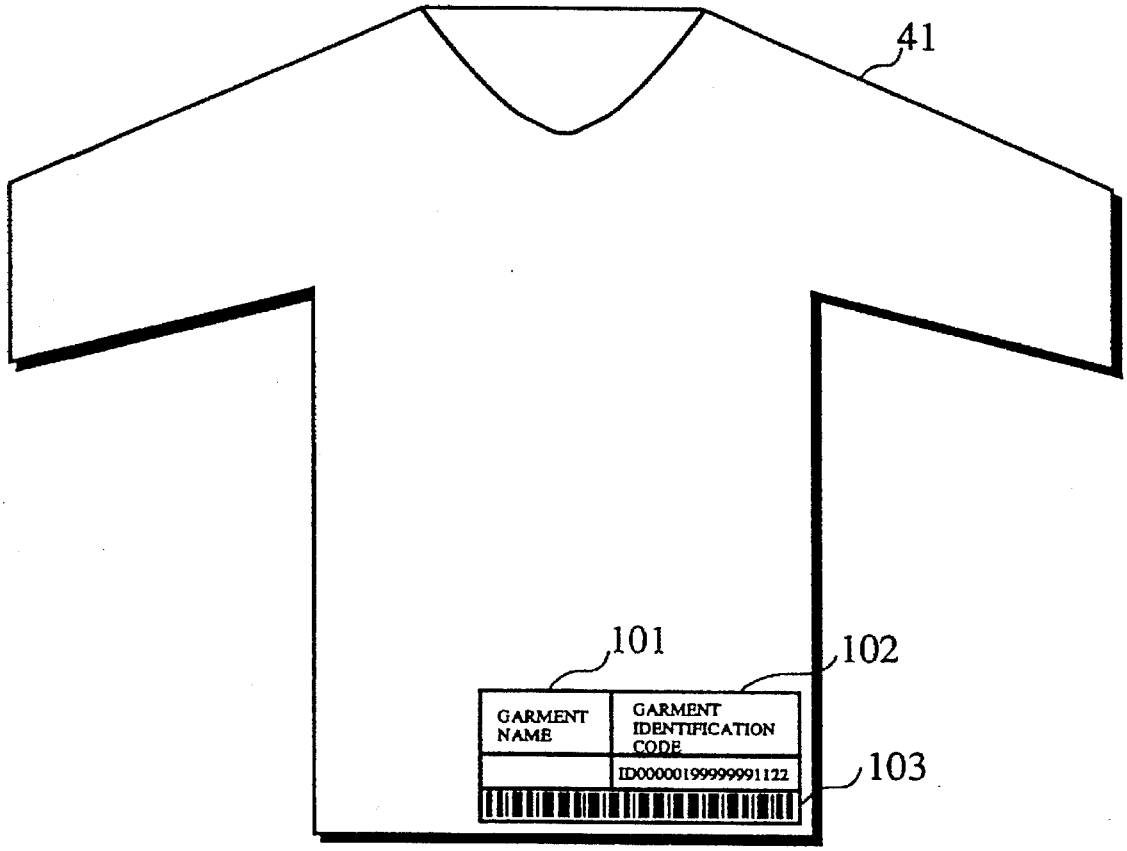

FIG. 10 is a drawing showing a garment to be washed which has a sewn-in label displaying the clothing type identification code used by the washing control device shown in FIG. 8. FIG. 10(*a*) shows an example of the garment identification code, with the garment name 101 given as [XXX clothing]and the garment identification code 102 given as [ID*00000019999991122*], with both of these being represented by the bar code 103. FIG. 10(*b*) shows the garment to be washed 41 (in this example, a sweater) into which the label 42 shown in FIG. 10(*a*) is sewn, with the bar code 103 included therein being able to be read by a bar code reader. In the same way as FIG. 4, the size of the label 42 has been exaggerated.

Figure 11:
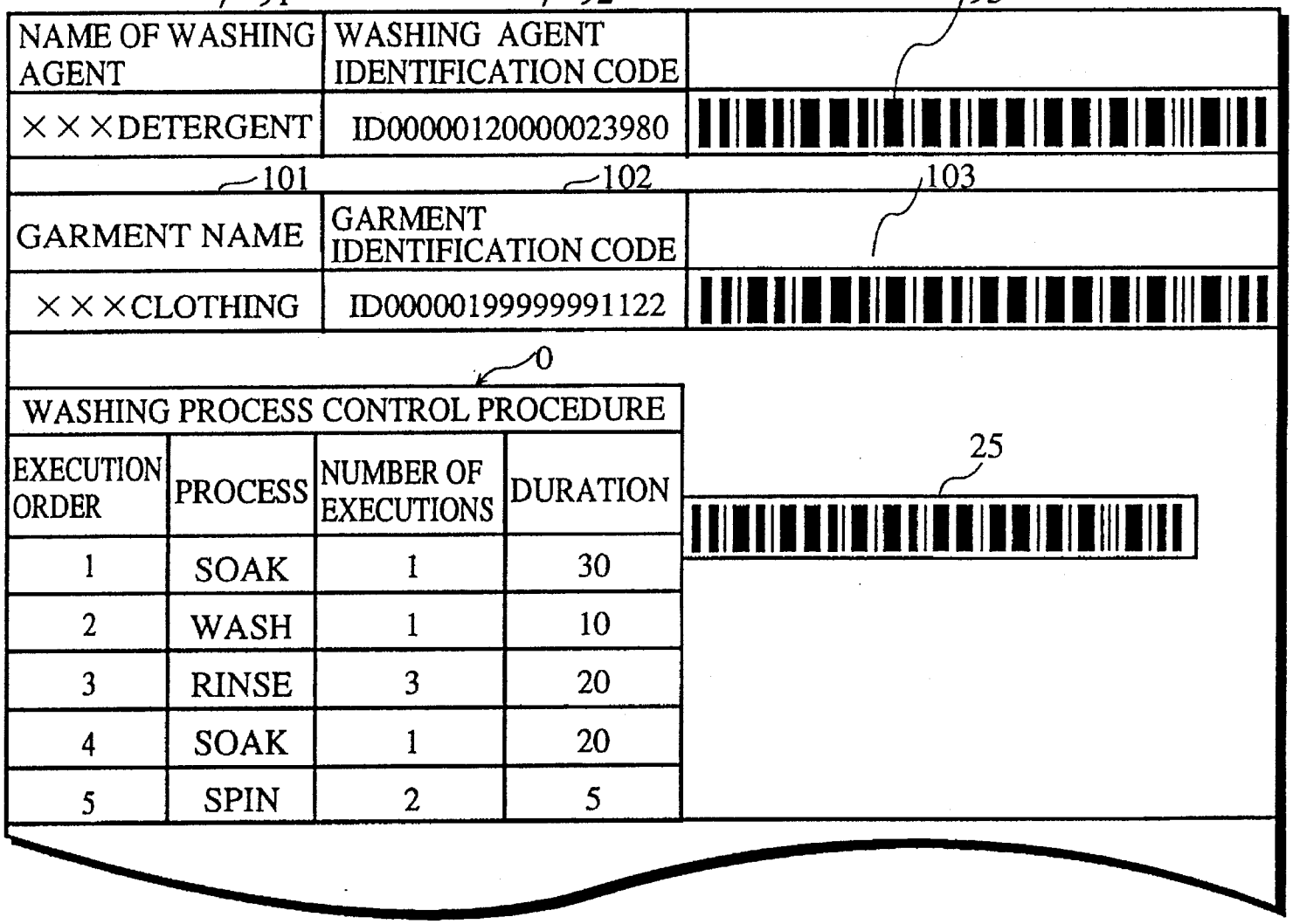
FIG. 11 is a drawing showing the washing process agent identification code and the clothing type identification code used by the washing control device shown in FIG. 8 and a table showing the corresponding washing process control procedure.

FIG. 11 is a drawing showing the washing process agent identification code and the clothing type identification code used by the washing control device shown in FIG. 8 and a table showing the corresponding washing process control procedure 0. In this table, the garment identification code 102 [ID00000019999991122], the garment name 101 [XXX clothing]and the washing agent identification code 92 [ID*00000120000023980*]for the name of washing agent 91 [XXX detergent]and the washing process control procedure 0 are combined and expressed as a combination of bar codes. This table is used when a given garment to be washed and a given washing agent require a certain washing process control procedure.

Figure 12:
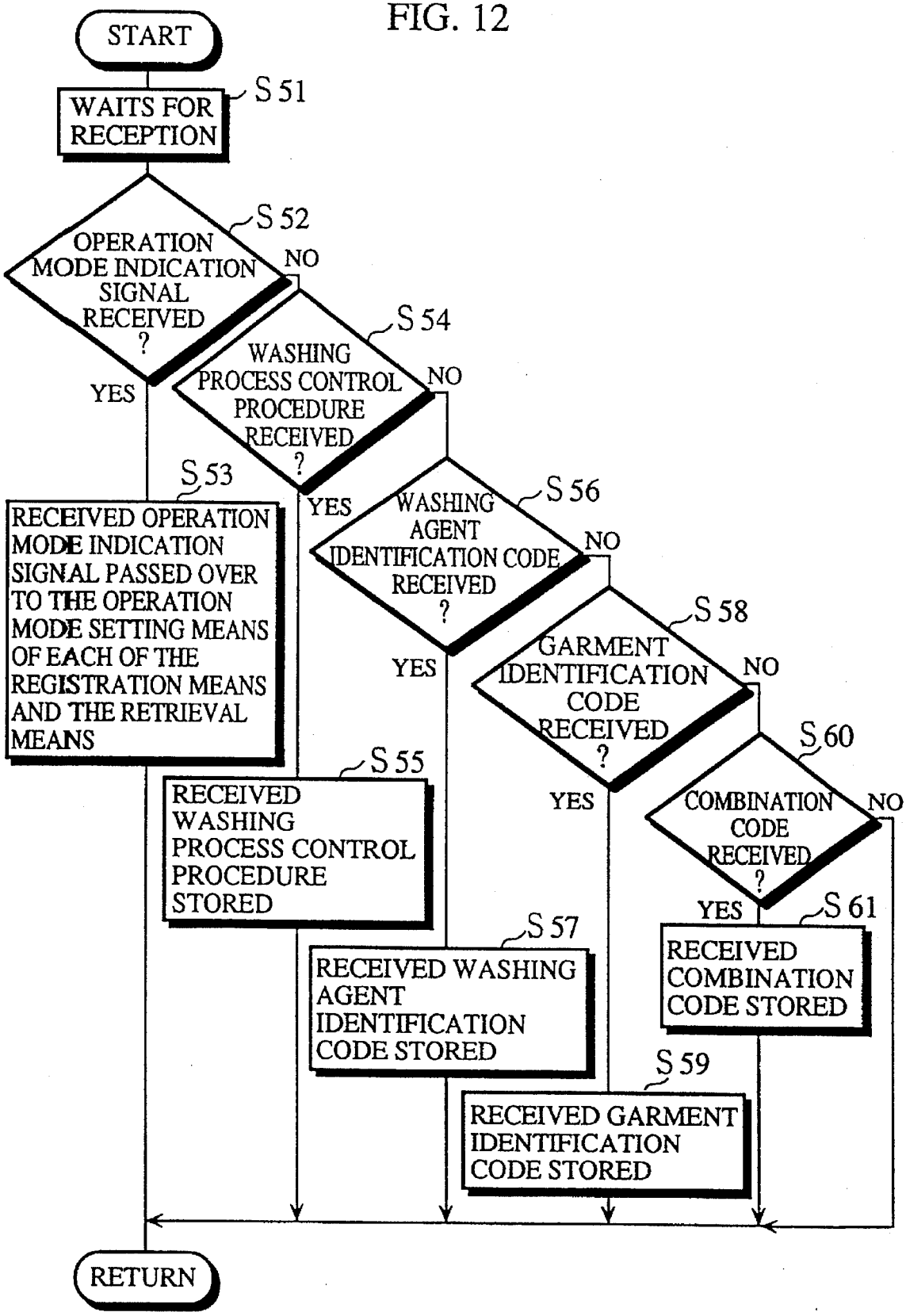
FIG. 12 is a flowchart for the operation of the reception means 84 shown in FIG. 8.

FIG. 12 is a flowchart for the operation of the reception means 84 shown in FIG. 8. First, the reception means 84 adopts a wait state for a transmission signal from the transmission unit 1(S51). If an operation mode indication signal is received from the transmission unit 1 (S52:Yes), then the received operation mode indication signal is passed over to the mode setting switch 88 in the registration means 85, or to the mode setting switch 89 in the retrieval means 87 (S53), before a return is performed.

Alternatively, when the washing process control procedure is received, (S52:No, S54:Yes), the reception means 84 stores the received washing process control procedure (S55), before a return is performed. In the same way, when a washing agent identification code is received (S54:No, S56:Yes), or when a garment identification code is received (S56:No, S58:Yes), or when a combination code of a washing agent identification code and a garment identification code is received (S58:No, S60:Yes), the reception means 84 stores the respective received information and a return is performed.

It should be noted that regarding the combination code, this can be formed by transmitting the washing agent identification code and then the garment identification code, or alternatively by first transmitting the garment identification code and then the washing agent identification code, with in either case both pieces of information being stored as the combination code.

Figure 13:
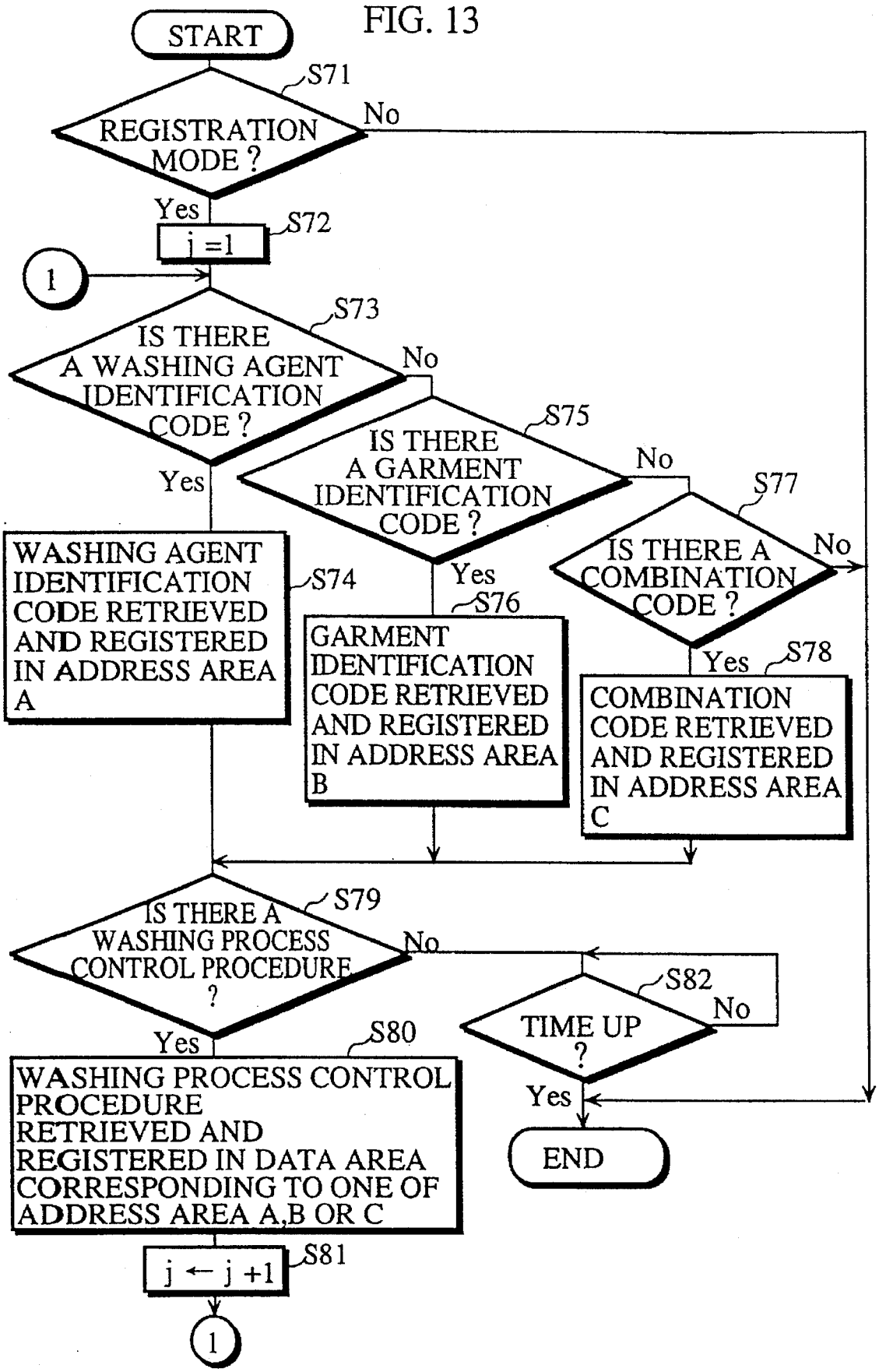
FIG. 13 is a flowchart for the operation of the registration means 85 shown in FIG. 8.

FIG. 13 is a flowchart for the operation of the registration means 85 shown in FIG. 8. First, when the registration mode is set by the mode setting switch 88 (S71:Yes), the registration means 85 sets the registration parameter j at one (S72). Next, when a washing agent identification code is being stored by the reception means 84 (S73:Yes), then this washing agent identification code is retrieved and registered in the address area A (S74).

In the same way, when a garment identification code is being stored by the reception means 84 (S73:No, S75:Yes), then this garment identification code is retrieved and is registered in address area B (S76). Also in the same way, when a combination code is being stored by the reception means 84 (S75:No, S77:Yes), then this combination code is retrieved and is registered in address area C (S78).

After the processes in S74, S76, or S78, it is confirmed that the washing process control procedure 0 is being stored by the reception means 84 (S79) and, when it is being stored (S79), this washing process control procedure 0 is retrieved and is registered in the data area corresponding to one of the address area A, or the address area B, or the address area C (S80). Following this, the parameter j is incremented by one (S81) and the process returns to S73.

Here, when the reception means 84 is not storing the washing process control procedures 0(S79:No), then the registration means 85 waits for a given time (S82:No) and then terminates the process.

FIG. 14 is a table showing a first example of the content of the washing process control procedures stored by the washing process control procedure storage means 86. Here, 92 is the washing agent identification code and 0 is a washing process control procedure. That is, the washing process control procedure 0 is stored corresponded to the washing agent identification code 92. In the example shown, a washing process control procedure with the same content as the content shown in FIG. 2 is stored corresponded to the washing agent identification code 92 [ID00000120000023980].

FIG. 15 is a table showing a second example of the content of the washing process control procedures stored by the washing process control procedure storage means 86. Here, 102 is the garment identification code and 0 is a washing process control procedure. That is, the washing process control procedure 0 is stored corresponded to the garment identification code 102. In the example shown, a washing process control procedure with the same content as the content shown in FIG. 2 is stored corresponded to the garment identification code 102 [ID00000199999991122].

FIG. 16 is a table showing a third example of the content of the washing process control procedures stored by the washing process control procedure storage means 86. Here, 161 is the combination code of the washing agent identification code and garment identification code, and 0 is a washing process control procedure. That is, the washing process control procedure 0 is stored corresponded to the combination code of the washing agent identification code and garment identification code. In the example shown, a washing process control procedure with the same content as the content shown in FIG. 2 is stored corresponded to the washing agent identification code 92 [ID00000120000023980]and the garment identification code 102 [ID00000199999991122].

Figure 17:
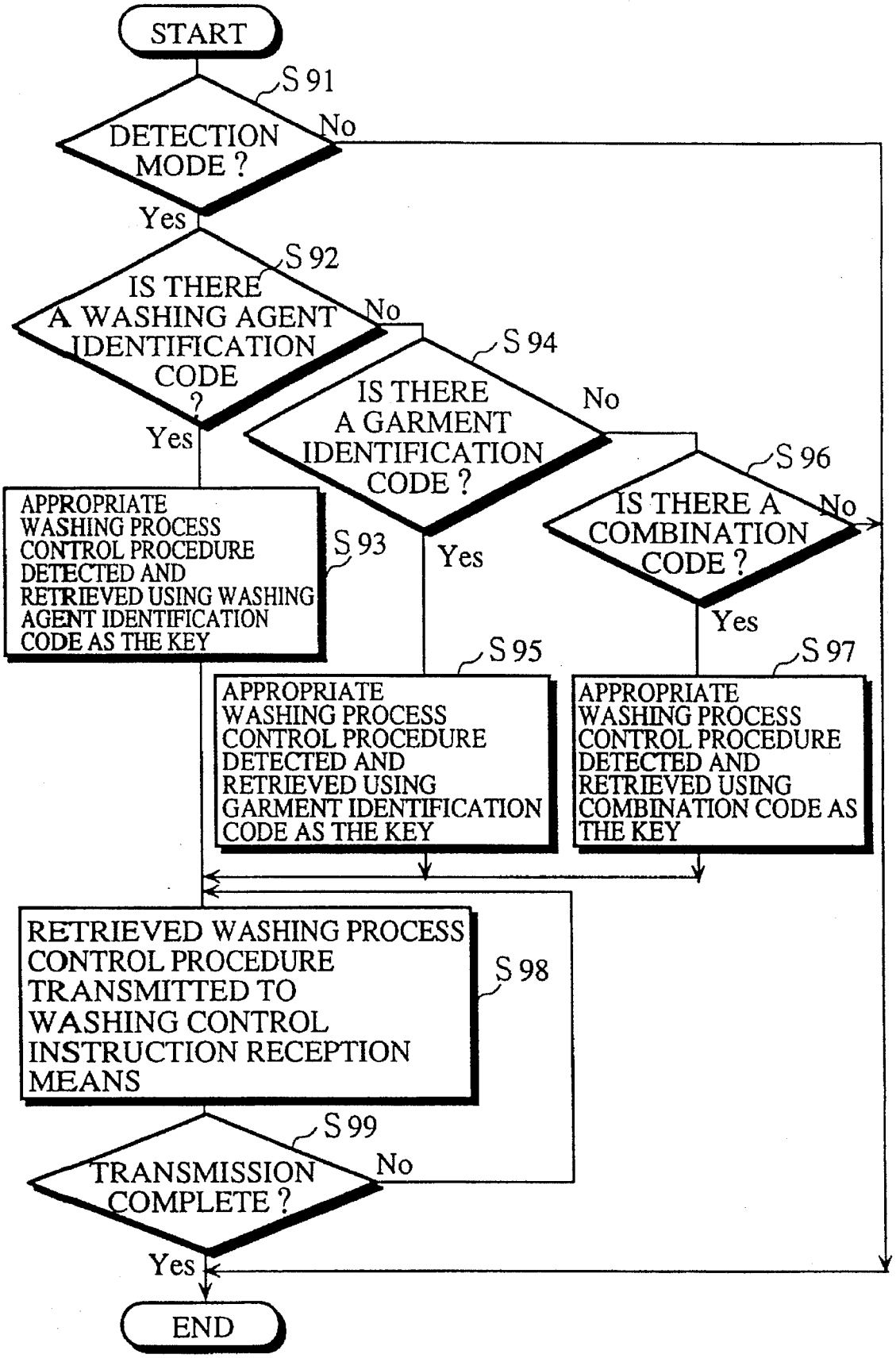
FIG. 17 is a flowchart showing the operation of the detection means 87 shown in FIG. 8.

FIG. 17 is a flowchart showing the operation of the detection means 87 shown in FIG. 8. First, when detection mode has been set by the mode setting switch 87 (S91:Yes), the detection means 87 confirms that the reception means 84 is storing the washing agent identification code (S92). When it finds that the reception means 84 is storing the washing agent identification code (S92:Yes), then this washing agent identification code is used as the key for detecting and retrieving the appropriate washing process control procedure out of the stored washing process control procedures 0 (S93).

In the same way, when the detection means finds that the reception means 84 is storing the garment identification code (S92:No, S94:Yes), then this garment identification code is used as the key for detecting and retrieving the appropriate washing process control procedure out of the stored washing process control procedures 0 (S95). Also, when the detection means finds that the reception means 84 is storing the combination code (S94:No, S96:Yes), then this combination code is used as the key for detecting and retrieving the appropriate washing process control procedure out of the stored washing process control procedures 0 (S97).

After executing one of steps S93, S95 or S97, the detection means 87 transmits the retrieved washing process control procedure to the washing process control procedure reception means 12 (S98). After this, it waits until the transmission is complete (S99:Yes), before terminating its operation.

In the way described above, by means of the washing control device of the present invention, since it is possible to have the washing process controlled in accordance with a washing process control procedure which it receives and interprets, this means that the washing process can be controlled with enough flexibility for a variety of washing loads, even for washing agents and garments which require the washing process to be controlled in a different manner to conventional processes. Furthermore, the operations to be made by the user are greatly simplified, and the washing results can be somewhat improved, meaning that operational value of this device is considerable.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A washing control system for executing washing processes by automatically controlling each washing process according to an appropriate washing process control procedure, comprising:

a washing process control procedure display mark which is an encoded set of washing instructions fixed according to at least one of a washing agent and a garment to be washed, said display mark being displayed on one of a washing agent package, a garment to be washed and a booklet;

reading means for reading the washing process control procedure display mark and at least one of a washing agent identification code displayed as a mark and a garment identification code displayed as a mark;

storage means for storing read washing process control procedures;

retrieval means for retrieving an appropriate washing process control procedure out of the stored washing process control procedures;

interpretation means for interpreting information in a retrieved washing process control procedure; and execution means for automatically controlling every washing process in accordance with the interpreted information in the washing process control procedure, wherein the washing process control procedure, the washing agent identification code and the garment identification code read by the reading means are each represented by a separate bar code, and the read washing process control procedure is a predetermined set of an execution order for each washing process, a number of executions for each washing process, an execution duration for each washing process and any other control information, for each separate washing case in accordance with one of a kind of washing agent, a kind of garment to be washed, and a combination of a kind of washing agent and a kind of garment to be washed.

2. The washing control device of claim 1, wherein the storage means stores each read washing process control procedure corresponded to one of a washing agent identification code, a garment identification code, and a combination of a washing agent identification code and a garment identification code.

3. The washing control device of claim 2, wherein the retrieval means retrieves the appropriate washing process control procedure out of the stored washing process control procedures using at least one of a washing agent identification code and a garment identification code as a retrieval key.

4. The washing control device of claim 3, wherein the interpretation means reads the washing process control procedure, written as a bar code, in order of execution for each washing process, interprets control information included therein and generates a control sequence for the control information.

5. The washing control device of claim 4, wherein the execution means controls every separate washing operation for each washing process in accordance with the generated control sequence.

6. The washing control device of claim 4, wherein the washing control system further includes:

first transmission means for transmitting, by means of one of a cable method and a cordless method, code for the read washing process control procedure, and at least one of the read washing agent identification code and the read garment identification code, in order to inform the interpretation means, and for transmitting an operation mode indication signal indicating an operation mode for a main washing machine, wherein an operation mode to be indicated to the main washing machine is one of a registration mode for registering a transmitted washing process control procedure and a retrieval mode for retrieving an appropriate washing process control procedure from the stored washing process control procedures;

first reception means for receiving, by means of one of a cable method and a cordless method, code for the transmitted washing process control procedure, and one of the transmitted washing agent identification code, the transmitted garment identification code and a transmitted combination of the washing agent identification code and garment identification code, wherein for cases when one of the washing agent identification code and the garment identification code is transmitted after the other, the first reception means receives the washing agent identification code and the garment identification code as a combination code;

registration means for registering, when an operation mode indication signal indicating registration mode is received, and passing over to the storage means a received washing process control procedure corresponded to one of the received washing agent identification code, the received garment identification code and the received combination of the washing agent identification code and garment identification code;

second transmission means transmitting a retrieved washing process control procedure in order to inform the interpretation means; and second reception means for receiving the washing process control procedure transmitted by the second transmission means in order to inform the interpretation means.

7. A washing system for automatically setting a washing process in a washing machine comprising;

a garment to be washed having a machine readable code setting forth characteristic washing procedures for the garment;

a container for a washing agent, the container having a machine readable code operatively associated with it for setting forth characteristic washing procedures for the washing agent;

machine reading means for reading the codes on the garment and the container and providing output signals; and execution means for responding to the output signals and providing control signals appropriate to the characteristic washing procedures for the garment to enable the washing process of the washing machine.

8. The washing system of claim 7, wherein the machine readable code is a bar code.

9. A washing system for automatically setting a washing process in a washing machine in correlation with a container for a washing agent, the container having a machine readable code operatively associated with it for setting forth characteristic washing procedures for the washing agent and a garment to be washed having a machine readable code setting forth characteristic washing procedures for the garment, comprising:

machine reading means for reading the respective codes on the garment and on the container to provide a garment output signal appropriate to the characteristic washing procedures for the garment and a washing agent output signal appropriate to the appropriate characteristic of the washing agent; and execution means for responding to the garment output signal and the washing agent output signal to set forth characteristic washing procedures suitable for the garment with the specific washing agent.

* * * * *